US005901446A

United States Patent [19]

Szymansky

[11] Patent Number: 5,901,446

[45] Date of Patent: May 11, 1999

[54] LONG HAIR CUTTING AND BEARD LIFTING FOIL CONSTRUCTION

[75] Inventor: Edward Szymansky, Fairfield, Conn.

[73] Assignee: Remington Corporation, L.L.C., Bridgeport, Conn.

[21] Appl. No.: 08/929,690

[22] Filed: Sep. 15, 1997

[51] Int. Cl.[6] ..... B26B 19/02

[52] U.S. Cl. ..... 30/43.92; 30/346.51

[58] Field of Search ..... 30/43.9, 43.92, 30/346.51, 43.6

[56] References Cited

U.S. PATENT DOCUMENTS

| | | | |
|---|---|---|---|
| 2,359,880 | 10/1944 | Scully | 30/43.6 |
| 2,440,586 | 4/1948 | Jost | 30/43.92 |
| 3,281,937 | 11/1966 | Starre et al. | 30/43.6 |
| 3,564,715 | 2/1971 | Driessen et al. | 30/346.51 |
| 4,139,940 | 2/1979 | Buras, Jr. et al. | 30/43.92 |

*Primary Examiner*—Hwei-Siu Payer
*Attorney, Agent, or Firm*—Melvin I. Stoltz

[57] ABSTRACT

By constructing an apertured foil with at least one zone having a thickness greater than the thickness of the remaining foil member and positioning the zone of increased thickness in the central area of the apertured foil, an apertured foil construction for a dry shaver is attained which provides greater control over the cutting and shaving of longer hair fibers simultaneously with the cutting/shaving of shorter hair fibers. In the preferred embodiments, either one or two increased thickness zones are employed to attain the optimum benefits of the present invention. In addition, the present invention is constructed to prevent the skin from entering the apertures, thereby preventing skin irritation.

17 Claims, 5 Drawing Sheets

LONG HAIR CUTTING AND BEARD LIFTING FOIL CONSTRUCTION

TECHNICAL FIELD

This invention relates to electric dry shavers and more particularly to improved foil construction for increasing the comfort and cutting efficiency of electric dry shavers.

BACKGROUND ART

Over the last several years, both men and women have been increasingly drawn to the advantages provided by electric dry shavers. In general, the consuming public has found that the use of razors or other systems is extremely inconvenient for removing or shaving short hair or stubble, as commonly found in mens' beards and on womens' legs. In addition, with the ever increasing time constraints and commitments individuals typically encounter, a fast and effective shaving system is most desirable.

The discomfort, as well as the time consumed in using shaving cream, soaps or gels in order to provide a medium for which a razor can be used, requires more time and inconvenience than most individuals are willing or capable of allowing. Furthermore, the cost of maintaining a sufficient supply of these products creates an additional burden. Consequently, electric dry shavers have become increasingly popular, as well as battery-operated electric dry shavers which can withstand exposure to moisture, thereby enabling individuals to simultaneously shower, as well as shave either beards or legs.

As the popularity of electric dry shavers increased, various product designs and alternate constructions proliferated, in an attempt to improve and enhance the comfort and cutting efficiency of such shavers. However, in spite of these product changes, difficulties have continued to exist in providing optimum results with optimum comfort.

One particular configuration has been found to be extremely efficacious in achieving high quality shaving results, as well as being extremely comfortable to use. This configuration comprises the various models of electric dry shavers incorporating a movable cutting blade which cooperates with a thin, flexible mesh screen or apertured foil.

In operation, the cutting blades are rapidly and continuously reciprocatingly moved against one side of the mesh screen or apertured foil, causing the cutting blades to repeatedly cross the plurality of apertures and provide a virtually continuous cutting action at each aperture. Then, by sliding or guiding the other side of the mesh screen or apertured foil over the skin surface to be shaven, the individual hair shafts enter the holes formed in the screen or foil and are cut by the movement of the cutting blades.

Although this dry shaving cutting system has proven to be extremely effective, as compared to other dry shaving products, one area of difficulty does exist which prior art systems have been unable to satisfactorily resolve. This area is the inability of prior art electric dry shavers incorporating apertured foils to effectively cut longer hair or whisker shanks or fibers. Longer hair shanks or fibers tend to be less rigid and, consequently, do not enter the apertures of the foil member as the dry shaver is moved over the skin surface. Instead of entering the apertures, the fibers tend to bend and be flexed away from the foil, thereby remaining uncut, leaving an unsatisfactory result.

In an attempt to resolve this continuing problem, some prior art apertured foil constructions enlarge the diameter of the apertures or employ elongated slots in order to allow the longer hair fibers to enter the apertures and be cut by the oscillating or reciprocating blades. However, it has been found that such constructions have been unable to fully satisfy the consumer's desire for a close and comfortable shave, since large diameters or elongated slots formed in apertured foils typically cause skin irritation.

It has been found that these prior art constructions, which incorporate larger diameter apertures and/or elongated slots, allow the skin surface to enter the aperture, along with the hair fibers. As a result, the blade movement cutting the hair fiber also rubs across the skin surface, resulting in cuts, abrasions, and/or skin irritations.

Another measure commonly employed in dry shavers is the incorporation of a separate trimmer which allows longer hair fibers to be cut by the trimmer. Although conventional trimmers have been found to be effective in cutting some hair fibers, these trimmers are incapable of satisfactorily cutting longer hair fibers on the face and neck of an individual in a manner which provides dependable, controlled cutting of such fibers.

Consequently, it is a principal object of the present invention to provide an improved apertured foil construction for electric dry shavers whereby longer hair fibers are consistently and dependably cut as part of the normal shaving operation.

Another object of the present invention is to provide an improved apertured foil construction for electric dry shavers having the characteristic features described above which is capable of providing substantially improved comfort and shaving efficiency, while also providing enhanced and improved results.

Another object of the present invention is to provide an improved apertured foil construction for electric dry shavers having the characteristic features described above which virtually eliminates any area wherein longer hair fibers are not cut due to the contours of the surface being shaved or the inability of the hair fibers to enter the apertured foil of the shaver.

A further object of the present invention is to provide an improved apertured foil construction for electric dry shavers having the characteristic features described above which virtually eliminates unwanted, unshaven areas.

Other and more specific objects will in part be obvious and will in part appear hereinafter.

SUMMARY OF THE INVENTION

In the present invention, the difficulties and drawbacks encountered in the prior art constructions have been eliminated by constructing the apertured foil with at least one zone having a thickness greater than the thickness of the remaining foil member and positioning the zone of increased thickness in the central area of the apertured foil. By employing this construction, it has been found that greater control over the longer hair fibers is achieved for guiding the longer hair fibers into the apertures of the foil, while also preventing portions of the skin from entering the apertures, In this way, skin irritation is prevented. As a result of this construction, substantially improved cutting of longer hair fibers is achieved and the problems encountered in prior art systems are virtually eliminated.

By employing the present invention, it has been found that a single, substantially centrally located area of enlarged thickness can be employed to attain the beneficial results achieved by the present invention. In addition, if desired, two or more substantially parallel zones of increased thickness can be employed to achieve similar beneficial results. Furthermore, depending upon the width employed for the increased thickness zone, conventional diameter circular shaped apertures can be employed, as well as circular apertures having larger diameters or elongated slots.

It has been found that by employing a plurality of narrow bands of increased thickness, with said bands being positioned substantially in the central section of the foil member, conventional diameter circular apertures can be employed to produce substantially enhanced cutting results on longer hair fibers. By employing this construction, the longer hair fibers are flexed by the narrow bands of increased thickness on the foil in a manner which causes the hair fibers to enter into the circular shaped apertures of the foil member located adjacent to the narrow bands. Once in these apertures, the continuous, oscillating cutting blades trims and cuts the hair fibers retained in therein. Even if the longer hair fiber is not trimmed to the surface of the skin, the shortening of the hair fiber to a more conventional length, enables the hair fiber to be trimmed to the desired skin surface as the shaver is passed over the same area as part of the normal shaving process.

In the alternate embodiment, it has been found that larger width zones of increased thickness are more effectively employed in combination with enlarged circular shaped apertures, elongated slots, or a combination of both. In this embodiment, it has been found that the larger width zones of increased thickness do not provide the fiber lifting and straightening achieved with smaller width zones. Consequently, larger diameter apertures or slots are preferably employed in order to enable the hair fibers to enter the apertures of the foil. However, due to the increased thickness of the zone in which the enlarged apertures are formed, any skin entering the enlarged apertures is prevented from coming into contact with the cutting blades. As a result, the desired shaving of the longer hair fibers is achieved, while skin irritation or cutting of the skin is prevented.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

By referring to FIGS. 1–8, along with the following detailed disclosure, two alternate embodiments of the present invention are fully detailed. However, these two alternate embodiments are provided for exemplary purposes only, and it is to be understood, that further alternate constructions or variations may be made in the foil configurations of the present invention while still incorporating the teaching of this invention. Consequently, both the drawings and the following detailed disclosure are provided as examples and are not intended to limit the present invention.

Figure 1:
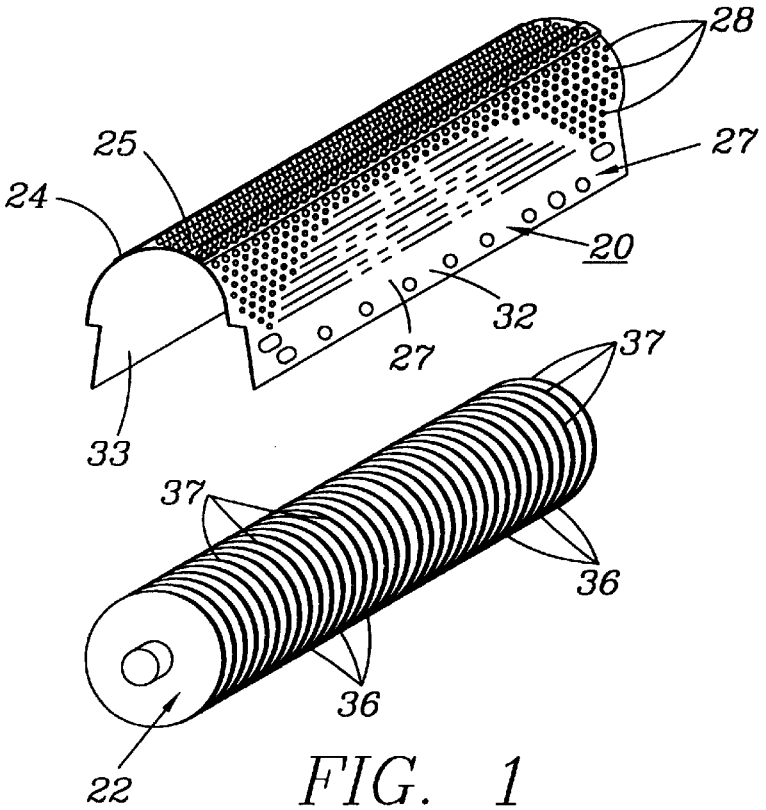
FIG. 1 is a perspective view of one embodiment of the apertured foil construction of the present invention incorporating two zones of increased thickness.
Figure 2:
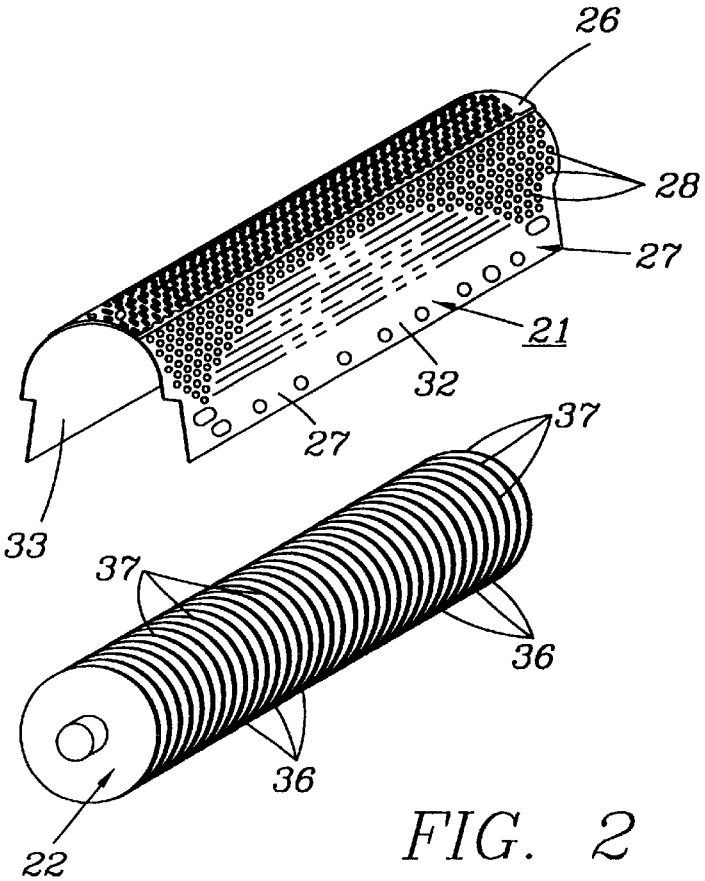
FIG. 2 is a perspective view of an alternate embodiment of the apertured foil of the present invention wherein a single zone of increased thickness is employed.

In FIG. 1, apertured foil member 20 is depicted ready for mounting in a generally conventional manner to an electric dry shaver (not shown), peripherally surrounding and cooperating with axially movable, reciprocating cutter assembly 22. Similarly, FIG. 2 depicts aperture foil member 21, as an alternate embodiment of the present invention, ready for mounting in the generally conventional manner to an electric dry shaver (not shown) peripherally surrounding and cooperatively associated with axially movable, reciprocating cutter assembly 22.

Throughout the drawings, both embodiments of foil members 20 and 21 are depicted as comprising a thin sheet of flexible material 27, preferably metallic in composition, with a plurality of apertures 28 formed therein. Furthermore, apertured foil members 20 and 21 are both defined by terminating edges 30, 30 and 31, 31. These terminating edges are constructed in a generally conventional manner, in order to enable apertured foil members 20 and 21 to be mounted to the desired shaver. In addition, apertured foil members 20 and 21 each comprise a longitudinally extending centerline "C", formed mid-way between edges 30, 30, an upper surface 32, and a lower surface 33.

In the embodiments depicted in FIGS. 1–8, apertured foil member 20 and 21 comprise constructions for mating, overlying, cooperative engagement with a single cutter assembly 22. However, if desired, apertured foil members 20 and 21 may be formed incorporating a plurality of arcuate zones constructed for cooperative engagement with an appropriate cutter assembly, as is well known in the art.

Regardless of whether a single arcuate curved zone or multiple arcuate curved zones are employed, apertured foil members 20 and 21 are constructed for overlying, cooperative relationship with cutter assembly 22. As is well known in the art, cutter assembly 22 incorporates a plurality of separate and independent blade members 36, each of which comprise a cutting edge 37, with the entire assembly constructed for rapid, side-to-side reciprocating movement. With lower surface 33 of apertured foil members 20 and/or 21 mounted in frictional, overlying, contacting engagement with cutting edges 37 of cutting blades 36 forming cutter assembly 22, the reciprocating movement of cutter assembly 22 in frictional contacting engagement with lower surface 33 of apertured foil members 20 and 21 provides the desired cutting action, shaving/cutting the hair fibers extending through apertures 28 formed in foil members 20 and 21.

In use, upper surface 32 of apertured foil members 20/21 is slidingly rubbed across the surface of the skin to be shaven, causing the hairs extending from the skin surface to enter apertures 28 and be severed by the movement of cutter assembly 22 across lower surface 33 of foil members 20 and 21. In this way, the removal of the beard or hair is attained and the desired clean shaven results are realized.

As detailed above, one of the difficulties encountered in prior art constructions is the inability of prior art apertured foil members to provide cutting of longer hair fibers during the normal shaving operation. However, by employing the present invention, this prior art drawback is virtually eliminated and substantially any hair fiber of any length is efficiently and effectively trimmed and cut by employing apertured foil members 20 and 21.

In the two alternate embodiments depicted in FIGS. 1 and 2, apertured foil members 20 and 21 each comprise a dual thickness construction integrally formed as part of foil members 20 and 21, in order to provide enhanced hair fiber cutting capabilities. In the embodiment represented by apertured foil member 20, separate and independent increased thickness zones 24 and 25 are integrally formed as part of apertured foil member 20, which comprises thin sheet material 27 with an otherwise substantially uniform thickness throughout.

In the preferred construction, increased thickness zones 24 and 25 are formed on upper surface 32, longitudinally, extending substantially the entire length of foil member 20, in juxtaposed, spaced, parallel relationship with each other. In addition, as is more fully detailed below, increased thickness zones 24 and 25 are formed in the central area of foil member 20, with thickness zones 24 and 25 being spaced, in opposite directions, from center line "C" of foil member 20. In the preferred embodiment, zones 24 and 25 are spaced away from the foil's center line "C" at substantially equal distances.

In the alternate embodiment depicted in FIG. 2, apertured foil member 21 incorporates a single elongated zone 26 of increased thickness formed on upper surface 32, extending substantially the entire length of foil member 21 and positioned along the center line thereof. In addition, increased thickness zone 26 is constructed with a substantially greater overall width than each of the increased thickness zones 24 and 25 depicted in FIG. 1.

Regardless of which embodiment of the present invention is employed, an apertured foil member of this invention is constructed with at least one zone of increased thickness formed on the upper surface thereof, longitudinally extending substantially the entire length of the foil member and positioned in the central zone of the foil member. By employing this construction, a foil member is attained which enables longer lengths of hair fibers to be cut as part of the normal shaving process. In this way, the difficulties typically encountered with prior art constructions are virtually eliminated.

By employing areas or zones of increased thickness as integral portions of the apertured foil, with the zones of increased thickness longitudinally extending substantially the entire length of the apertured foil, while the remainder of the foil member comprises a substantially uniform thickness, the zones of increased thickness contact hairs of greater length during the normal shaving process as the apertured foil is rubbed over the skin surface being shaven. As the longer length hair fibers contact a zone of increased thickness, the hair fiber is flexed and once released from the increased thickness zone, the hair fiber attempts to return to its normal, elongated, straightened position.

Once in this straightened configuration, the hair fiber is in a position to enter one of the apertures formed in the foil member, enabling the hair fiber to be cut by the interaction of cutter assembly 22 with apertured foil member 20 or 21. As a result, by employing the zones of increased thickness, hair fibers of greater length are automatically trimmed and cut during the normal shaving process, producing a comfortable, clean and thorough shave with long hair fiber stubble being virtually eliminated.

Figure 3:
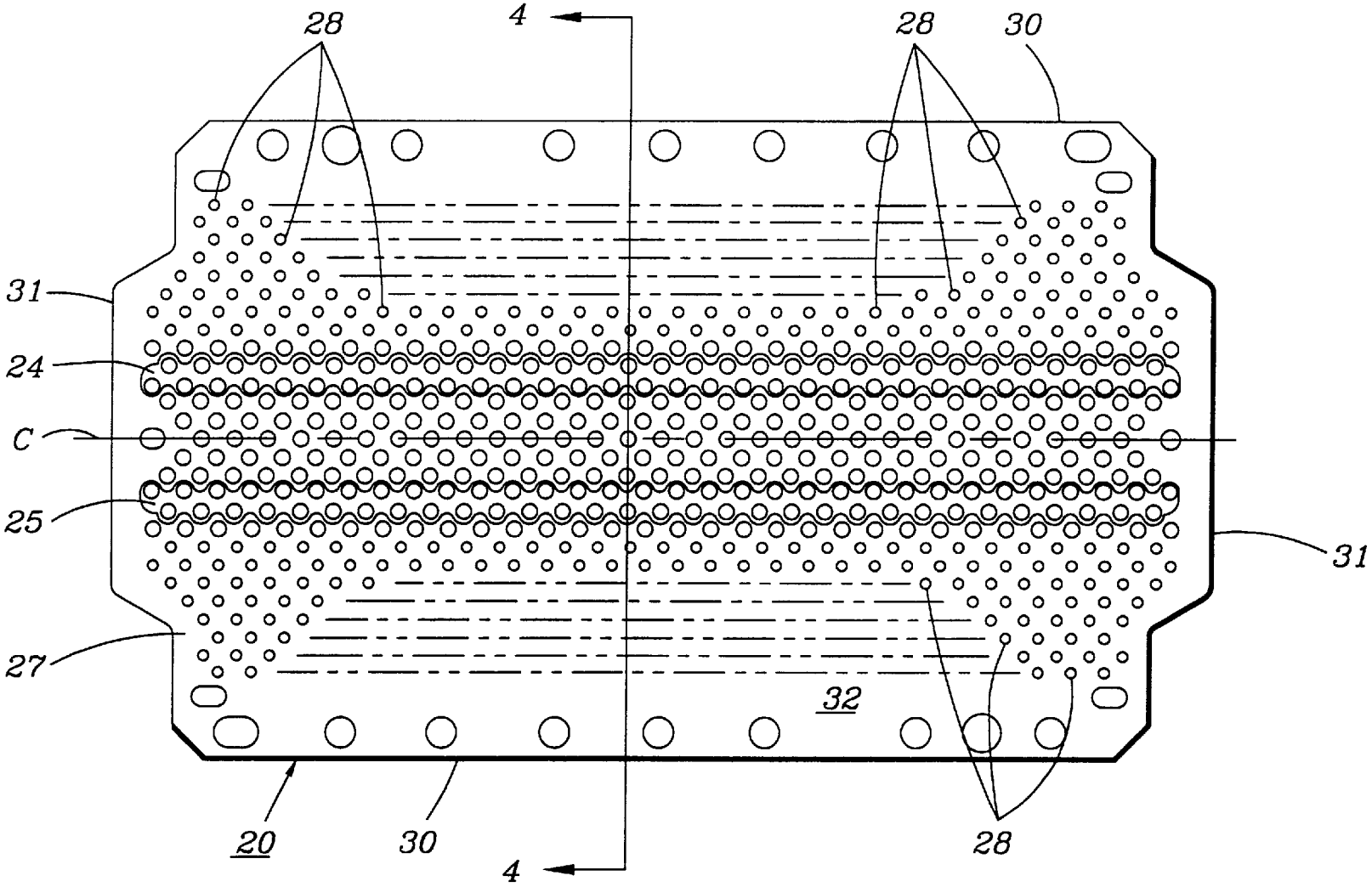
FIG. 3 is a top plan view of the embodiment of the apertured foil construction of FIG. 1.
Figure 4:
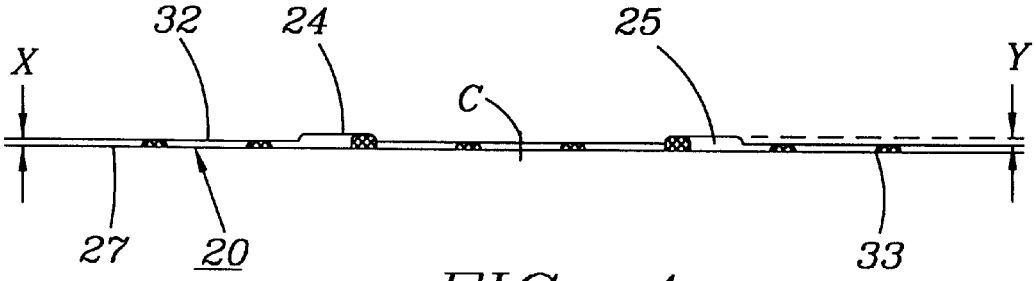
FIG. 4 is an enlarged cross-sectional side elevation view of the apertured foil member of this invention taken along line 4—4 of FIG. 3.
Figure 5:
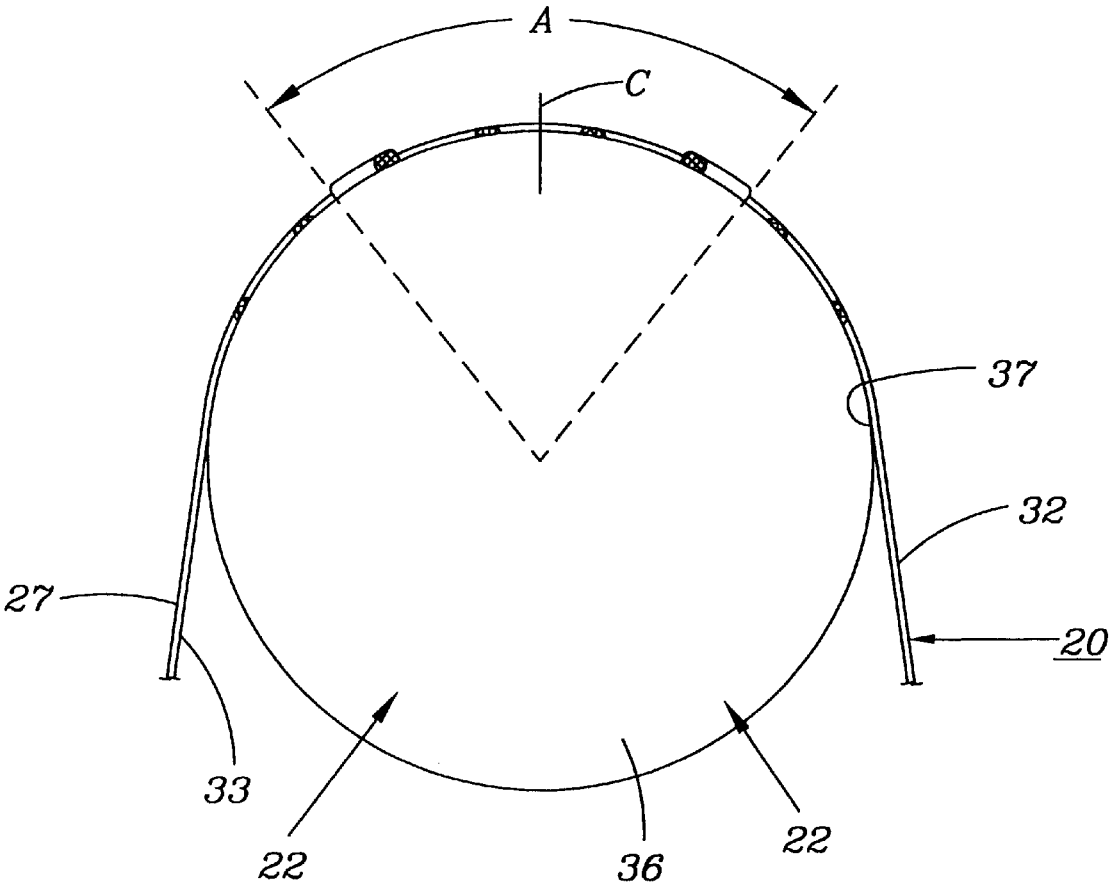
FIG. 5 is a cross-sectional side elevation view, partially broken away, depicting the apertured foil member of FIG. 1 mounted to a cutter assembly.

By referring to FIGS. 3, 4, and 5, along with the following detailed discussion, the preferred construction and operation of apertured foil member 20 can best be understood. As shown in these figures, apertured foil member 20 has an overall configuration and construction which is generally conventional for securely mounting apertured foil member 20 in a dry shaver peripherally surrounding and frictionally engaging cutting edges 37 of blades 36 of cutter assembly 22 in order to attain the desired hair fiber cutting results.

As discussed above and shown in FIG. 4, apertured foil member 20 is formed with an overall substantially uniform thickness "X", extending throughout the length and width thereof. The only area wherein the thickness of apertured foil 20 differs from thickness of X is increased thickness zones 24 and 25. As depicted, zones 24 and 25 both comprise elongated areas having a total thickness designated as "Y" which is substantially greater than thickness X.

It has been found that in order to attain the desired hair cutting results achieved by incorporating increased thickness zones 24 and 25 into apertured foil member 20, thickness Y is formed with a dimension which is 1.5 to 3 times greater than the dimension of thickness X. Furthermore, although increased thickness zones 24 and 25 falling within this range have been found to be effective in producing substantially improved hair cutting results, in the preferred embodiment thickness Y is formed with a dimension which is about twice the dimension of thickness X.

In the preferred construction, increased thickness zones 24 and 25 are also formed with an overall width which encompasses one to three adjacent rows of apertures 28 as formed in foil member 20. In addition, increased thickness zones 24 and 25 are spaced apart from each other a distance corresponding to the width formed by two and eight rows of apertures 28.

As shown in FIG. 3, the preferred embodiment of apertured foil member 20 incorporates increased thickness zones 24 and 25 with an overall width substantially equivalent to two rows of adjacent apertures 28, and are spaced apart a distance substantially equivalent to the distance established by five separate and distinct adjacent rows of apertures. As is evident from the foil depicted in FIG. 3, the longitudinally extending rows of apertures are formed with a nested or staggered configuration in order to provide a maximum population density of apertures 28 in this area. As a result, zones 24 and 25 are spaced apart by a lateral distance equal to either two or three apertures. However, due to the staggered or offset packing of the aperture rows, this distance is equivalent to five rows of apertures.

Furthermore, increased thickness zones 24 and 25 are formed in the central section of apertured foil 20, with zone 24 being spaced away from center line C of apertured foil 20 the substantially equivalent distance that increased thickness zone 25 is spaced away from center line C, in the opposite direction. In this way, increased thickness zones 24 and 25 are positioned substantially in the central area of apertured foil member 20 for providing optimum control and cooperation with the portion of foil member 20 in contact with the blades of cutter assembly 22.

It is well known in this art that apertured foil members are preferably constructed and mounted to the shaver in a manner which optimizes the contact of lower surface 33 of apertured foil member 20 with cutting edges 37 of blades 36 forming the cutter assembly 22. In this regard, foil member 20 is constructed to provide a natural or inherent radius of curvature which conforms with the radius of curvature of cutting edges 37 of cutting blades 36 of cutter assembly 22. By having the radius of curvature of foil member 20 closely conform to the radius of curvature of cutting edges 37 of cutting blades 36 of cutter assembly 22, the desired shaving of the hair fibers is attained with optimum efficiency.

Many factors control the natural radius of curvature of an apertured foil and influence the ability of the apertured foil to closely conform with and remain in overlying contacting engagement with the cutting edges of the cutting blades of the cutter assembly. The principal factors controlling the curvature of a foil member are (1) the material selected for forming the flexible thin sheet, (2) the thickness of the thin sheet of flexible material, and (3) the size, shape, and positioning of the apertures formed in the foil member. By varying these elements, the precisely desired flexibility and arcuate curvature is attained.

In this embodiment of the present invention, as shown in FIGS. 4 and 5, thickness X of thin sheet of flexible material 27 forming apertured foil member 20 is constructed to assure that apertured foil member 20 peripherally surrounds cutting edges 37 of cutting blades 36 forming cutter assembly 22 to produce the desired, close, overlying, frictional contacting engagement therebetween. Preferably, the contacting engagement between inside surface 33 of apertured foil member 20 and cutting blades 36 of cutter assembly 22 encompasses an arcuate distance ranging between about 160° and 175°.

In order to assure that apertured foil member 20 remains in close, frictional contacting engagement with cutting edges 37 of cutting blades 36 forming cutter assembly 22 throughout the entire shaving operation, the positioning and thickness of increased thickness zones 24 and 25, as well as the arcuate spacing therebetween, must be carefully controlled. In this regard, the total arcuate distance extending between the distal edges of increased thickness zones 24 and 25, which includes the arcuate distance between zones 24 and 25, is controlled by the size, shape, and positioning of apertures 28 formed in foil member 20. However, as detailed above, the embodiment shown in FIG. 3, is merely one example of the preferred construction, and is not intended to limit the present invention thereto.

Although the arcuate width of increased thickness zones 24 and 25 and the arcuate spacing therebetween, can vary, depending upon the particular construction of the apertured foil, it has been found that the maximum arcuate distance "A" extending between increased thickness zones 24 and 25, including the arcuate spacing therebetween, ranges between about 60° and 80°. This arcuate distance "A" is clearly detailed in FIG. 5.

Although it has been found that an arcuate distance A ranging between about 60° and 80° provides the desired results in attaining cutting of longer hair fibers, while still enabling apertured foil member 20 to incorporate circular apertures of substantially conventional diameters, it has been found that the arcuate distance A preferably comprises 70°. By employing this construction, optimum cutting of the hair fibers is achieved, as well as optimum manipulation of longer hair fibers in a manner which enables the fibers to be flexed and enter apertures 28 of foil member 20 during the normal shaving process, for being cut and trimmed by the reciprocating action of cutters 22, relative to apertured foil member 20.

Although any desired aperture configuration and dimension can be employed, without departing from the scope of the present invention, apertured foil member 20 is preferably constructed with the apertures incorporated within the central zone thereof comprising circular shapes having a diameter ranging between about 0.018 inches and 0.024 inches. In addition, the preferred overall thickness of apertured foil member 20 ranges between about 0.0015 inches and 0.003 inches.

As detailed above, increased thickness zones 24 and 25 each comprise a thickness Y which ranges between 1.5 and 3 times the thickness X of the overall apertured foil member 20. Consequently, in the preferred embodiment, the thickness of increased thickness zones 24 and 25 preferably range between about 0.0022 inches and 0.009 inches, with twice the thickness of X being preferred, for an optimum thickness of 0.003 inches to about 0.006 inches.

Figure 6:
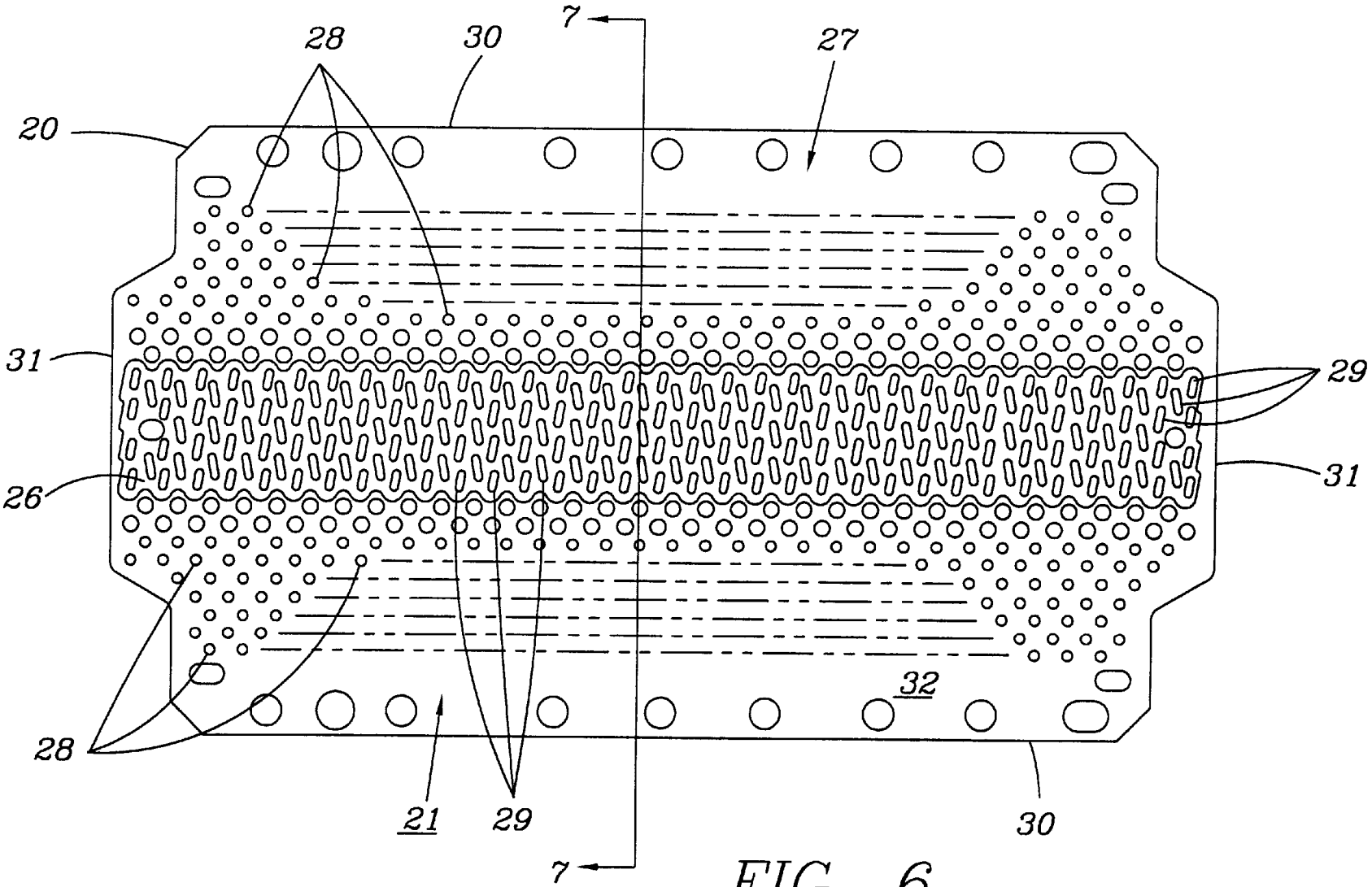
FIG. 6 is a top plan view of the embodiment of the apertured foil construction depicted in FIG. 2.
Figure 7:
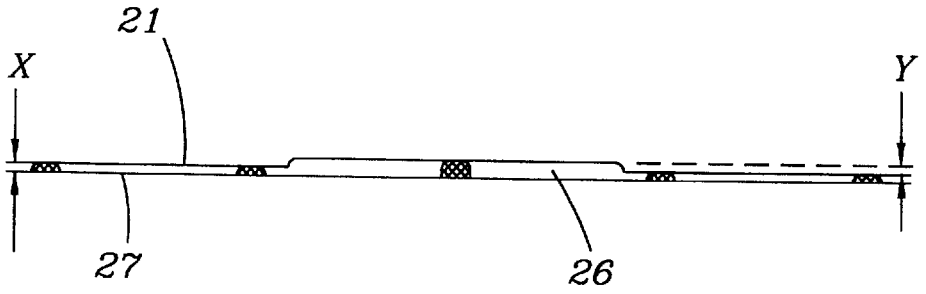
FIG. 7 is an enlarged cross-sectional side elevation view of the apertured foil member of this invention taken along line 7—7 of FIG. 6.
Figure 8:
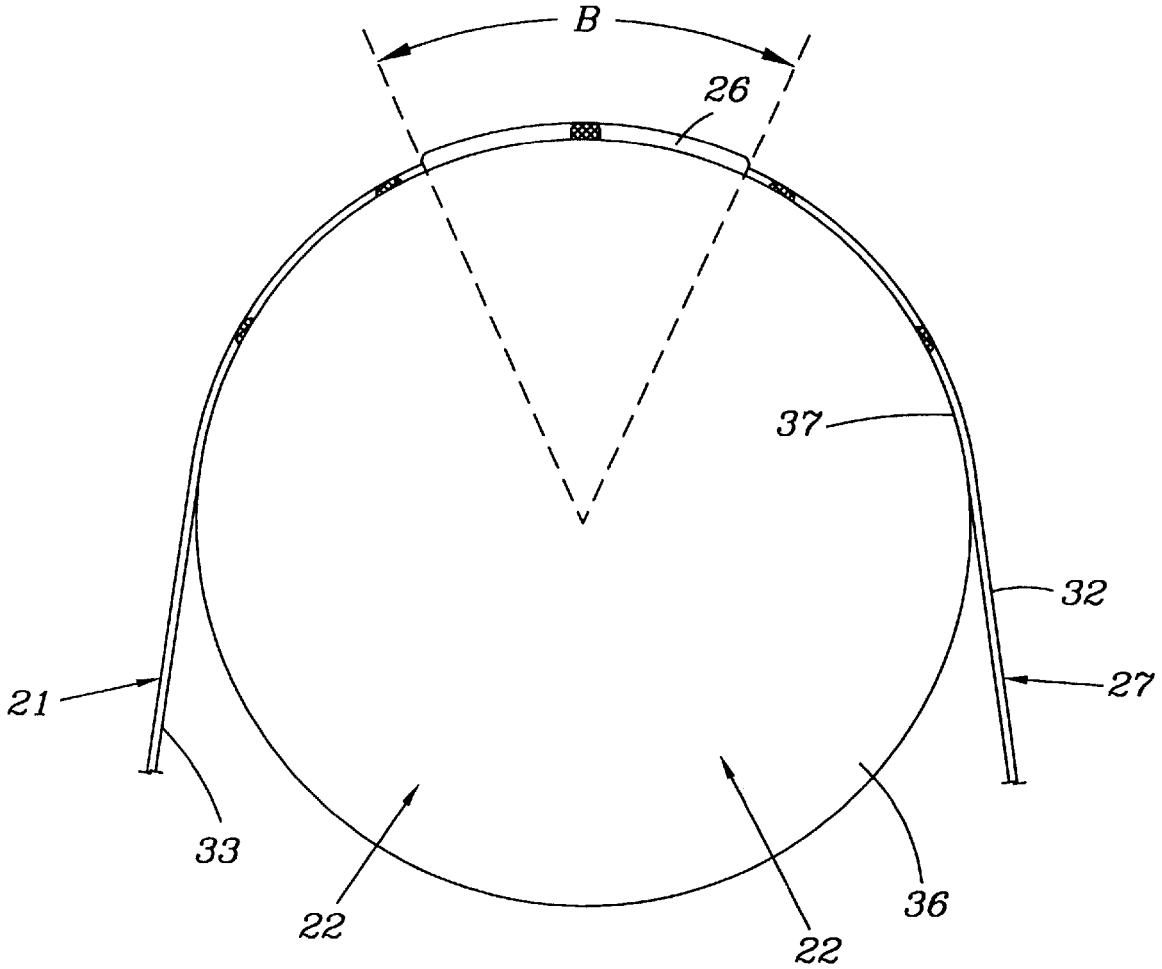
FIG. 8 is a cross-sectional side elevation view, partially broken away, depicting the apertured foil member of FIG. 2 mounted to a cutter assembly.

By referring to FIGS. 6, 7, and 8, along with the following detailed discussion, the preferred construction and operation of apertured foil member 21 can best be understood. As shown in these figures, apertured foil member 21 has an overall configuration and construction which is generally conventional for securely mounting apertured foil member 21 in a dry shaver peripherally surrounding and frictionally engaging cutting edges 37 of blade 36 of cutter assembly 22 in order to attain the desired hair fiber cutting results.

As discussed above and shown in FIG. 7, apertured foil member 21 is formed with an overall substantially uniform thickness X, extending throughout the length and width thereof. The only area wherein the thickness of apertured foil 21 differs from a thickness of X is in increased thickness zone 26. As depicted therein, increased thickness zone 26 comprises a single elongated area having a total thickness designated at Y which is substantially greater than thickness X.

It has been found that in order to attain the desired hair cutting results achieved by incorporating increased thickness zone 26 into apertured foil member 21, thickness Y is formed with a dimension which is 1.5 to 3 times greater than the dimension of thickness X. Furthermore, although increased thickness zone 26 falling within this range has been found to be highly effective in producing substantially improved hair cutting results, in the preferred embodiment, thickness Y is formed with a dimension which is about twice the dimension of thickness X.

In the preferred construction of this embodiment of the present invention, the single increased thickness zone 26 is preferably formed with elongated, slotted apertures 29 formed therein, as opposed to substantially circular apertures 28 employed in the remainder of apertured foil 21, as well as in the construction of apertured foil member 20.

In this embodiment, in addition to providing the interaction between increased thickness zone 26 and longer hair fibers, as detailed above, with regard to the flexing action achieved by contact of the longer hair fibers with increased thickness zone 26, it has been found that optimum cutting of the longer hair fibers is achieved by incorporating slotted apertures 29 throughout the entire increased thickness zone 26. However, although slotted apertures 29 substantially enhance the ease of entry of longer hair fibers into apertured foil 21, enabling the hair fibers to be cut by the movement of cutter assembly 22, the typical prior art problems encountered with slotted apertures is avoided.

As discussed above, one of the drawbacks found with conventional prior art apertured foil members incorporating elongated slot zones is the production of irritation at the skin level caused by contact of the cutting blades with the skin. However, by employing slotted apertures 29 in only the area defined by increased thickness zone 26, entry of the skin surface into apertures 29 of foil 21 is prevented. In the present invention, increased thickness zone 26 assures a greater spaced distance between the skin surface of cutting edges 37 of blade members 26 of cutter assembly 22, thereby preventing contact of cutting edge 37 with the skin surface in the area of slotted apertures 29. As a result, a comfortable, close shave is attained along with cutting of longer hair fibers simultaneously with the shorter hair fibers.

As clearly shown in FIG. 6, the preferred embodiment of apertured foil member 21 incorporates seven separate and independent longitudinally extending rows of elongated apertures 29 in the area defined by increased thickness zone 26. Furthermore, each of these slotted apertures are formed with a width ranging between about 0.010 inches and 0.014 inches and a length ranging between about 0.024 inches and 0.042 inches.

In order to further assure a compact, fully integrated aperture construction, slotted apertures 29 are formed with each row thereof being staggered or offset both in position and arcuately in order to assure maximum population density of slotted apertures 29 in the area defined by increased thickness zone 26. As depicted, this optimum staggered or offset construction is preferably attained by having the center line defining the length of each aperture 29 formed at an acute angle to edge 31 in a first direction, with the next row formed at a similar acute angle to edge 31 in the opposite direction. Each of the subsequent rows are then repeated following the same pattern. In this way, the desired offset or staggered construction is realized and slotted apertures 29 are formed with a substantially increased and optimized packing density.

In the preferred construction of this embodiment of the present invention, increased thickness zone 26 is formed in the central section of apertured foil 21, with increased thickness zone 26 being mounted substantially midway between edges 30, 30. In this way, increased thickness zone 26, with slotted apertures 29 formed therein, is positioned in the optimum location for contacting the skin and attaining the desired close, clean, cutting and shaving of both long hair and short hair fibers.

As discussed above, apertured foil 21 is constructed in a manner which optimizes the contact of lower surface 33 of apertured foil member 21 with cutting edges 37 of blades 36 forming cutter assembly 22. In this regard, foil member 21 is constructed to provide and possess a natural or inherent radius of curvature which conforms with the radius of curvature of cutting edges 37 of blades 36. By providing a radius of curvature for foil member 21 which closely conforms to the radius of curvature of the cutting edges 37 of cutting blades 36, the desired shaving and cutting interaction of the hair fibers with cutting blades 36 is attained with optimum efficiency.

The same factors detailed above control the radius of curvature of apertured foil member 21 and influence the ability of apertured foil member 21 to closely conform with and remain in overlying contacting engagement with cutting edges 37 of cutting blades 36. With these factors in mind, the thickness X of thin sheet of flexible material 27 forming apertured foil member 21 is closely controlled, as well as the thickness and arcuate width of increased thickness zone 26.

In the preferred construction of this embodiment of the present invention, as shown in FIGS. 7 and 8, thickness X of thin sheet of flexible material 27 forming apertured foil member 21 is constructed to assure that apertured foil member 21 peripherally surrounds cutting edges 37 of cutting blades 36 to produce the desired, close, overlying, frictional contacting engagement therebetween. Preferably, the contacting engagement between inside surface 33 of apertured foil member 21 and cutting blades 36 of cutter assembly 22 encompasses an arcuate distance ranging between about 160° and 175°.

In order to assure that apertured foil member 21 remains in close frictional contacting engagement with cutting edges 37 of cutting blades 36 throughout the entire shaving operation, the width and thickness of increased thickness zone 26 is carefully controlled. As shown in FIG. 8, the total arcuate width is depicted as arcuate distance "B".

In this embodiment, it has been found that arcuate distance B preferably ranges between about 40° and 60° to provide the desired enhanced cutting action, while still maintaining a radius of curvature which closely conforms with the radius of curvature of cutting edges 37 of cutting blades 36. Furthermore, although an arcuate distance ranging between about 40° and 60° does provide the desired results, the preferred optimum arcuate distance B comprises 50°.

By employing this construction, optimum cutting of the hair fibers is achieved. In addition, optimum manipulation of long hair fibers is attained in a manner which enables the hair fibers to be flexed and enter slotted apertures 29 of foil member 21 during the normal shaving process. In this way, the longer hair fibers are cut and trimmed by the reciprocating action of cutters 22 relative to apertured foil 21, while preventing any unwanted skin irritation.

As discussed above, apertured foil member 21 provides a close, comfortable, irritation-free shave by controlling thickness Y, in addition to the other elements detailed above. As discussed, thickness Y preferably ranges between 1.5 and 3 times thickness X of the remainder of overall apertured foil member 21. In the preferred construction of this embodiment, thickness X preferably ranges between about 0.0015 inches and 0.003 inches. Consequently, the thickness of increased zone 26 preferably ranges between about 0.0022 inches and 0.009 inches.

Although it has been found that thickness Y preferably ranges between 1.5 and 3 times the dimension of thickness X, it has been found that the preferred, optimum dimension for thickness Y is twice the dimension of thickness X. As a result, the preferred, optimum construction of apertured foil member 21 comprises an increased thickness zone 26 having an overall thickness ranging between about 0.003 inches and 0.006 inches.

It will thus be seen that the objects set forth above, among those made apparent from the preceding description, are efficiently attained and, since certain changes may be made in the above article without departing from the scope of the invention, it is intended that all matter contained in the above description or shown in the accompany drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A foil for dry shavers constructed for cooperating engagement with a reciprocating blade assembly having a plurality of blade members, the cutting edges of which are in sliding frictional engagement with one surface of the foil, said foil comprising A. a substantially flat sheet of thin, flexible material defined by a. a first pair of juxtaposed, spaced, shaver-mounting edges, b. a second pair of juxtaposed, spaced side edges extending between and interconnecting said shaver-mounting edges, and c. a first thickness forming the thickness of a substantial portion of the flat sheet, B. a plurality of apertures formed in said flexible material, C. said plurality of apertures being aligned in a plurality of rows formed between the juxtaposed, spaced side edges and the shaver-mounting edges, and D. two separate and distinct increased thickness zones a. formed on a central area of the substantially flat sheet of thin, flexible material and being positioned at substantially equal distances from opposed shaver-mounting edges, and longitudinally extending substantially the entire length of the foil, and b. comprising a second thickness having a measured dimension larger than the measured dimension of the first thickness, whereby a foil construction is obtained which is capable of effectively cutting both long hair and short hair fibers.

2. The foil defined in claim 1, wherein each of said increased thickness zones are further defined as being spaced apart from each other a distance substantially equal to between about 3 and 8 rows of apertures.

3. The foil defined in claim 2, wherein said two increased thickness zones are further defined as being spaced apart a distance substantially equal to 5 rows of apertures and the apertures formed between said increased thickness zones are further defined as comprising circular shapes having a diameter ranging between about 0.018 inches and 0.024 inches.

4. The foil defined in claim 2, wherein the total arcuate width between said two increased thickness zones comprises between about 60° and 80°.

5. The foil defined in claim 2, wherein each of said increased thickness zones are further defined as comprising circular shaped apertures formed therein, with said apertures being aligned in a plurality of rows ranging between about 1 and 3 rows.

6. The foil defined in claim 5, wherein each of said increased thickness zones are further defined as comprising two rows of apertures.

7. A foil for dry shavers constructed for cooperating engagement with a reciprocating blade assembly having a plurality of blade members, the cutting edges of which are in sliding frictional engagement with one surface of the foil, said foil comprising A. a substantially flat sheet of thin, flexible material defined by a. a first pair of juxtaposed, spaced, shaver-mounting edges, b. a second pair of juxtaposed, spaced side edges extending between and interconnecting said shaver-mounting edges, and c. a first thickness forming the thickness of a substantial portion of the flat sheet, B. a plurality of apertures formed in said flexible material, C. said plurality of apertures being aligned in a plurality of rows formed between the juxtaposed, spaced side edges and the shaver-mounting edges, and D. at least one separate and distinct increased thickness zone a. formed on the substantially flat sheet of thin, flexible material in a position which is substantially central and substantially equidistant from the shaver-mounting edges, and b. comprising a second thickness having a measured dimension larger than the measured dimension of the first thickness, whereby a foil construction is obtained which is capable of effectively cutting both long hair and short hair fibers.

8. The foil defined in claim 7, wherein the ratio of said second thickness to said first thickness ranges between about 1.5 and 3.

9. The foil defined in claim 8, wherein said second thickness comprises a dimension which is twice the dimension of the first thickness.

10. The foil defined in claim 8, wherein said first thickness comprises a measured dimension ranging between about 0.0015 inches and 0.003 inches, and said second thickness comprises a measured dimension ranging between about 0.0022 inches and 0.009 inches.

11. The foil defined in claim 10, wherein said second thickness is further defined as comprising a measured dimension ranging between about 0.003 inches and 0.006 inches.

12. The foil defined in claim 1, wherein said increased thickness zone is further defined as comprising a length extending substantially the entire length of the foil and a width comprising an arc ranging between about 40° and 60°.

13. The foil defined in claim 12, wherein said width of said increased thickness zone is further defined as comprising 50°.

14. The foil defined in claim 12, wherein said increased thickness zone is further defined as comprising a plurality of elongated slotted-shaped apertures formed therein extending throughout the entire increased thickness zone.

15. The foil defined in claim 14, wherein said slotted apertures are further defined as being formed in said increased thickness zone in close proximity to each other for maximizing the number of apertures formed therein.

16. The foil defined in claim 14, wherein each of said slotted apertures are further defined as comprising a width ranging between about 0.010 inches and 0.014 inches and a length ranging between about 0.024 inches and 0.042 inches.

17. The foil defined in claim 7, wherein said plurality of apertures formed in the flexible material comprising the first thickness are further defined as being formed in a plurality of longitudinally extending rows, with each of said apertures having a substantially circular shape.

* * * * *